US012181169B1

(12) United States Patent
Ren et al.

(10) Patent No.: US 12,181,169 B1
(45) Date of Patent: Dec. 31, 2024

(54) AIR CONDITIONING SYSTEM

(71) Applicant: Nanjing Bailing Automotive Electrical Machinery Co., Ltd., Nanjing (CN)

(72) Inventors: Guoyin Ren, Nanjing (CN); Peihao Ren, Nanjing (CN)

(73) Assignee: Nanjing Bailing Automotive Electrical Machinery Co., Ltd., Nanjing (CN)

( * ) Notice: Subject to any disclaimer, the term of this patent is extended or adjusted under 35 U.S.C. 154(b) by 0 days.

(21) Appl. No.: 18/410,109

(22) Filed: Jan. 11, 2024

(30) Foreign Application Priority Data

Dec. 18, 2023 (CN) ..... 202311741441.2

(51) Int. Cl.
*F24F 11/86* (2018.01)

(52) U.S. Cl.
CPC ..... *F24F 11/86* (2018.01)

(58) Field of Classification Search
CPC ... F28D 11/00; F28D 11/06; F28F 5/00; F28F 2280/10
See application file for complete search history.

(56) References Cited

U.S. PATENT DOCUMENTS 2,072,486 A * 3/1937 Smith ..... F24F 3/1405 62/176.1
3,852,976 A * 12/1974 Hintze ..... F25B 3/00 62/499
3,980,129 A * 9/1976 Bergdahl ..... F24F 12/002 165/59
4,064,932 A * 12/1977 Iriarte ..... F24F 12/002 165/909
4,971,139 A * 11/1990 Khattar ..... F24F 12/002 165/96
9,242,525 B2 * 1/2016 Kobayashi ..... B60H 1/3226
9,581,380 B1 * 2/2017 Quesada Saborio . F25D 23/006
11,034,233 B2 * 6/2021 Oliveira ..... B60K 11/085
2019/0171260 A1 * 6/2019 Chou ..... G06F 1/206
2020/0290452 A1 * 9/2020 Oliveira ..... B60K 11/04

FOREIGN PATENT DOCUMENTS

CN 111219872 A * 6/2020 ..... F24H 1/145
CN 113932639 A * 1/2022

* cited by examiner

*Primary Examiner* — Nelson J Nieves
(74) *Attorney, Agent, or Firm* — Getech Law LLC; Jun Ye

(57) ABSTRACT

An air conditioning system includes a compressor, a condenser, a throttling device and an evaporator. The compressor and the throttling device are respectively connected to the evaporator and are connected to the condenser. The condenser includes a shell internally provided with a cavity. A base is fixedly connected to a bottom wall of the cavity. A heat dissipation base plate and a motor body are fixedly connected to a top wall of the base. A heat conducting aluminum flat tube is fixedly connected to a side wall of the cavity. The heat conducting aluminum flat tube is connected to the heat dissipation base plate. The heat dissipation base plate is provided with more than two heat dissipation fins. The heat conducting aluminum flat tube is arranged on the heat dissipation base plate. A fan blade is fixedly connected to a motor output shaft of the motor body.

5 Claims, 6 Drawing Sheets

AIR CONDITIONING SYSTEM

TECHNICAL FIELD

The present invention relates to the technical field of air conditioning, and particularly relates to an air conditioning system.

BACKGROUND

Definition of air conditioning: air conditioning is an abbreviation for air conditioning. A temperature, humidity, cleanliness and an airflow velocity of indoor air (or artificial mixed gas) are conditioned by means of devices and technologies to meet the comfort requirement of people on the environment or the process requirement of production on the environment.

An air conditioner which meets the comfort requirement of human kind or other creatures is usually called as a comfort air conditioner. An air conditioner which mainly satisfies the operating requirements on the process production course and equipment and the comfort requirement of a human body is usually called as a process air conditioner.

The air conditioner mainly includes four components: a compressor, a condenser, a throttling device and an evaporator. The condenser plays a role of cooling high-temperature and high-pressure steam sent by the compressor to a low-temperature and high-pressure gas-liquid mixture. However, an existing condenser merely uses a fan for cooling, so that the cooling efficiency needs to be improved.

SUMMARY

To solve the technical problem, the present invention aims to provide an air conditioning system. To solve the technical problem, the present invention is achieved by the following technical solution:

An air conditioning system, including a compressor, a condenser, a throttling device and an evaporator, where the compressor and the throttling device are respectively connected to the evaporator and are respectively connected to the condenser;

the condenser includes a shell, the shell is internally provided with a cavity, a base is fixedly connected to a bottom wall of the cavity, a heat dissipation base plate and a motor body are fixedly connected to a top wall of the base, a heat conducting aluminum flat tube is fixedly connected to a side wall of the cavity, the heat conducting aluminum flat tube is connected to the heat dissipation base plate, the heat dissipation base plate is provided with more than two heat dissipation fins, the heat conducting aluminum flat tube is arranged on the heat dissipation base plate, and a fan blade is fixedly connected to a motor output shaft of the motor body; and the heat dissipation base plate is provided with a movable assistant heat dissipation mechanism, and the movable assistant heat dissipation mechanism is connected to the motor output shaft.

Beneficially, the movable assistant heat dissipation mechanism includes a worm gear, a worm, a reducer, an incomplete gear, a first spur gear, a take-up reel, a drive line, a first guide wheel, a second guide wheel and a heat dissipation tank; the worm gear is fixedly connected to the motor output shaft; the worm is rotatably connected to the side wall of the cavity; the worm meshes with the worm gear; the worm is fixedly connected to an input end of the reducer; the reducer is fixedly connected to a back wall of the cavity; the incomplete gear is fixedly connected to an output end of the reducer; the first spur gear is fixedly connected to the take-up reel; the take-up reel is rotatably connected to the side wall of the cavity; the first guide wheel and the second guide wheel both are rotatably connected to the back wall of the cavity; one end of the drive line is fixedly connected to the take-up reel and the other end of the drive line bypasses the first guide wheel and the second guide wheel and is fixedly connected to the heat dissipation tank; the heat dissipation tank is provided with a heat dissipation cavity and a T-shaped trough; the heat dissipation cavity is internally filled with a refrigerant; two inner walls of the T-shaped trough are slidably connected to two side walls of the heat dissipation base plate, respectively; the inner walls of the T-shaped trough are in contact with the heat conducting aluminum flat tube; and the heat dissipation tank is made from a heat conduction material.

Beneficially, the movable assistant heat dissipation mechanism further includes a block, a first elastic member, a first turning wheel, a drive belt, a second turning wheel, a first bevel gear, a connecting plate, a sliding block, a second bevel gear, an extension piece, a second elastic member, a pump body and an L-shaped push rod; a bottom wall of the heat dissipation cavity is connected to a bottom wall of the heat dissipation tank through a liquid outlet channel, the block is connected to the bottom wall of the heat dissipation cavity through the first elastic member, the base is provided with a liquid storage cavity, the liquid storage cavity is internally filled with the refrigerant, a top wall of the liquid storage cavity is connected to the top wall of the base through a liquid return channel, the top wall of the base is provided with a groove, the first turning wheel is fixedly connected to the worm, the first turning wheel is connected to the second turning wheel through the drive belt, the second turning wheel is rotatably connected to the connecting plate, the first bevel gear is fixedly connected to the second turning wheel, the connecting plate and the pump body both are fixedly connected to the top wall of the base, the sliding block is slidably connected to an inner wall of the groove, a bottom wall of the sliding block is connected to a bottom wall of the groove through the second elastic member, the second bevel gear is rotatably connected to a top wall of the sliding block, the extension piece is fixedly connected to a side wall of the sliding block, the pump body is provided with a pump cavity, an impeller is rotatably connected to an inner wall of the pump cavity, a third bevel gear is fixedly connected to the impeller, the third bevel gear extends out of the pump body, the third bevel gear and the first bevel gear respectively mesh with the second bevel gear, a soft liquid outlet tube and a liquid suction tube connected to the pump cavity are fixedly connected to the pump body, the liquid suction tube extends into the liquid storage cavity, one end of the soft liquid outlet tube is fixedly connected to the heat dissipation tank and the other end of the soft liquid outlet tube is connected to the heat dissipation cavity, a hanging strip is fixedly connected to the back wall of the cavity, and the soft liquid outlet tube is hung on the hanging strip.

Beneficially, the heat dissipation tank is provided with a cleaning mechanism; the cleaning mechanism includes a connecting piece, a third elastic member, a cleaning strip and a first drive protrusion; and the connecting piece is fixedly connected to the heat dissipation tank, the cleaning strip is slidably connected to the heat dissipation tank, the cleaning strip is connected to the connecting piece through the third elastic member, the first drive protrusion is fixedly connected to the cleaning strip, and more than two second drive protrusions are fixedly connected to the side wall of the cavity.

Beneficially, a recovery tank is detachably connected to the bottom wall of the cavity.

Beneficially, a method for manufacturing the heat dissipation fins includes: extruding, by upper and lower dies, folds to form the heat dissipation fins, and the heat dissipation fins are wavy.

Beneficially, a material of the heat dissipation fins includes trace elements.

Beneficially, each of the heat dissipation fins is provided with more than two fin troughs.

Beneficially, the heat dissipation fin is provided with more than two fin bumps.

Beneficially, a thickness of the heat dissipation fin is 0.06-0.20 mm.

The present invention has the beneficial effects that

Driven by the motor body, a cleaning hairbrush in terms of a conventional technology can rotate to generate wind power, and the heat dissipation tank can also be driven to reciprocate up and down, so that the heat dissipation tank performs contact heat transfer with different parts of the heat conducting aluminum flat tube and matches with the cleaning hairbrush to complete assistant heat dissipation, so that the heat dissipation efficiency is improved and the heat dissipation function of the heat dissipation tank is ensured. The cleaning strip and the cleaning hairbrush can also be driven to clean the heat dissipation fins while the heat dissipation tank reciprocates up and down, so that the heat dissipation function of the heat dissipation fins is ensured;

the heat dissipation fins are manufactured by extrusion forming the upper and lower dies. The formed wavy heat dissipation fins feature large area and increased wind drag, so that the heat dissipation effect can be improved. The heat dissipation fins can be directly flushed with water, so that the condenser is conveniently used in a severely polluted environment, for example, an agricultural machine. The added trace elements manganese and silicon both have good heat conduction performance and collapse resistance. The heat dissipation fins are superior to conventional fins. Manganese is high in hardness, so that the rigidity of the heat dissipation fins can be improved, and the performance to resist external forces is improved.

BRIEF DESCRIPTION OF DRAWINGS

The present invention is further described by utilizing drawings, and the embodiments in the drawings do not constitute limitation to the present invention. Those of ordinary skill in the art further may obtain other drawings according to the drawings without making creative efforts.

Figure 1:
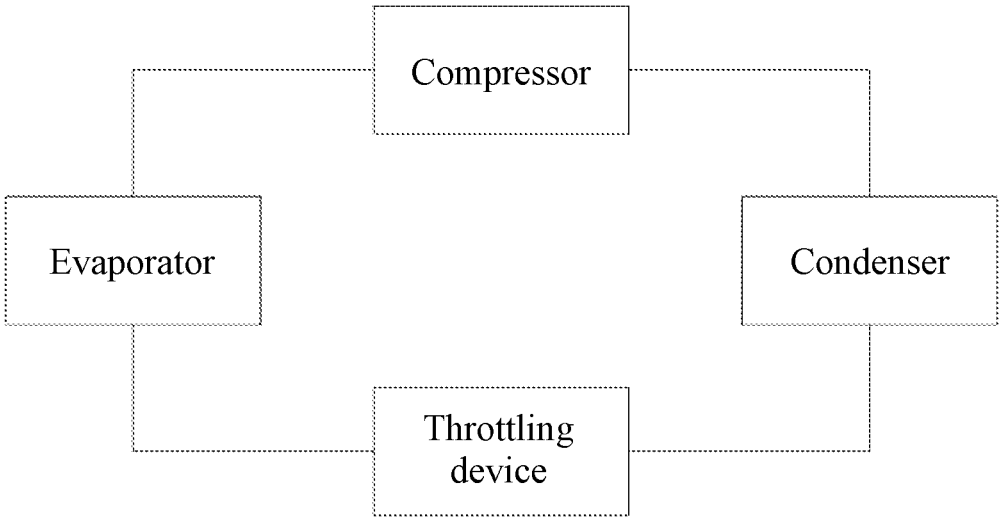
FIG. 1 is a structural schematic diagram of an air conditioning system provided by the present invention.

Numerals in the drawings: 1, shell; 2, cavity; 3, base; 4, heat conducting aluminum flat tube; 5, heat dissipation base plate; 6, heat dissipation fin; 7, motor body; 8, motor output shaft; 9, fan blade; 10, worm gear; 11, worm; 12, reducer; 13, incomplete gear; 14, first spur gear; 15, take-up reel; 16, drive line; 17, first guide wheel; 18, second guide wheel; 19, heat dissipation tank; 20, heat dissipation cavity; 21, liquid outlet channel; 22, block; 23, first elastic member; 24, first turning wheel; 25, drive belt; 26, second turning wheel; 27, first bevel gear; 28, connecting plate; 29, sliding block; 30, second bevel gear; 31, extension piece; 32, second elastic member 33, pump body; 34, pump cavity; 35, third bevel gear; 36, impeller; 37, soft liquid outlet tube; 38, liquid suction tube; 39, liquid storage cavity; 40, liquid return channel; 41, L-shaped push rod; 42, groove; 43, hanging strip; 44, T-shaped trough; 45, connecting piece; 46, third elastic member; 47, cleaning strip; 48, first drive protrusion; 49, cleaning hairbrush; 50, second drive bump; 51, recovery tank; 52, fin trough.

DETAILED DESCRIPTION OF EMBODIMENTS

The technical solution in the embodiments of the present invention will be clearly and completely described below in combination with the drawings in the embodiments of the present invention. Apparently, the embodiments described are merely some rather than all of the embodiments of the present invention. On the basis of the embodiments in the present invention, all other embodiments obtained by those skilled in the technical field without creative efforts fall into the scope of protection of the present invention.

In description of the present invention, it is to be noted that orientation or position relationships indicated by terms: 'vertical', 'upper', 'lower', 'horizontal' and the like are orientation or position relationships indicated by the drawings and are only to describe the application and simplify the description rather than indicates or implies that the indicated device or components must have specific orientations and are configured and operated in the specific orientations. Therefore, it cannot be construed as limitations to the present invention. In addition, the terms 'first', 'second', 'third' and 'fourth' are only used for a description purpose rather than being construed to indicate or imply relative importance.

In the description of the present invention, it is to be further noted that unless otherwise specified and defined, terms 'arranging', 'mounting', and 'connecting', 'connection' should be understood in a broad sense, for example, arranging', 'mounting', and 'connecting', 'connection' can be either fixed connection or detachable connection or integrated connection; can be either mechanical connection, electric connection or direct connection and can be either connection via an intermediation or internal communication of two components. Those of ordinary skill in the art can understand specific meaning of the terms in the present invention under specific circumstances.

Figure 2:
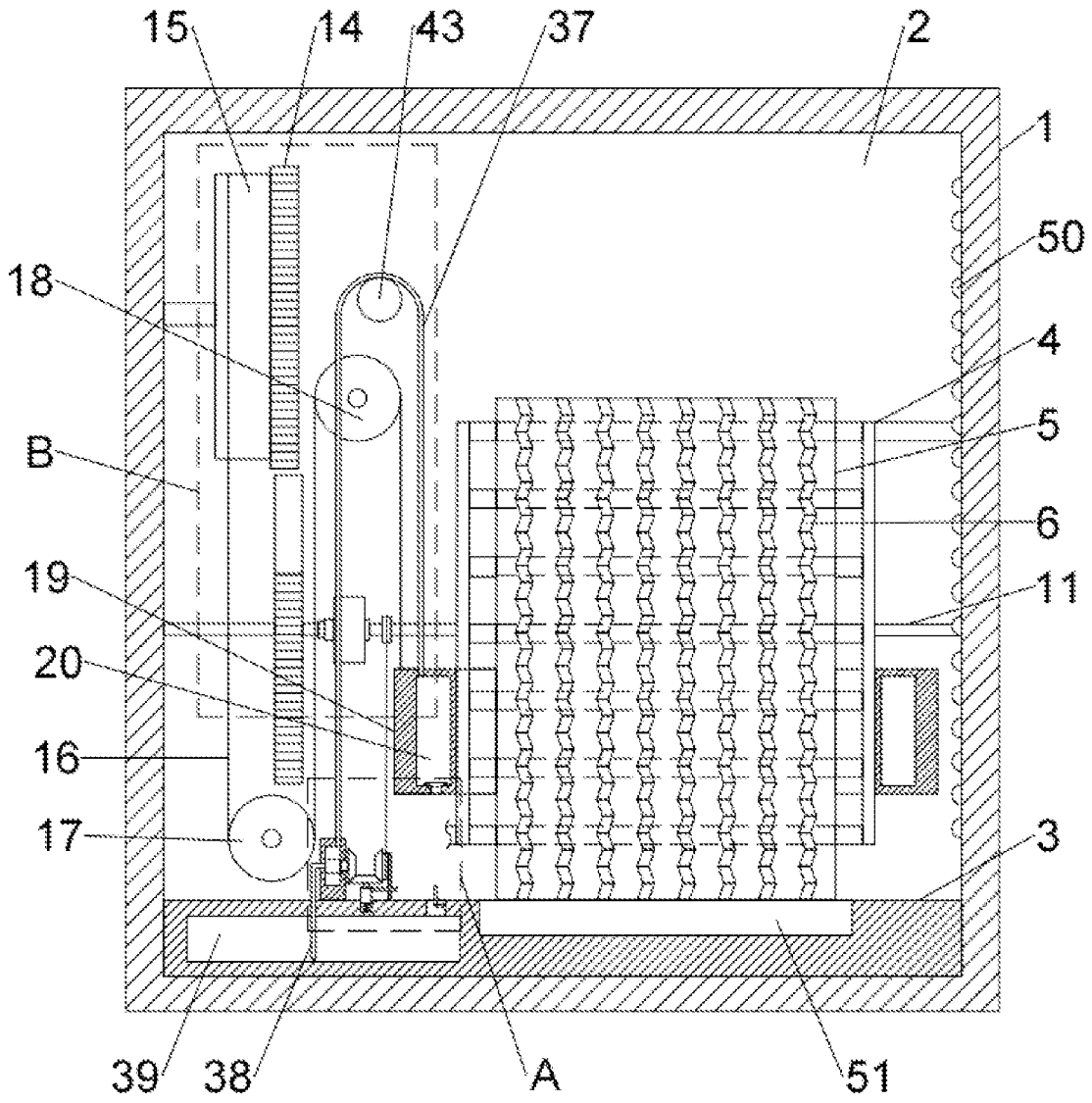
FIG. 2 is a structural schematic diagram of a condenser in the air conditioning system provided by the present invention.
Figure 3:
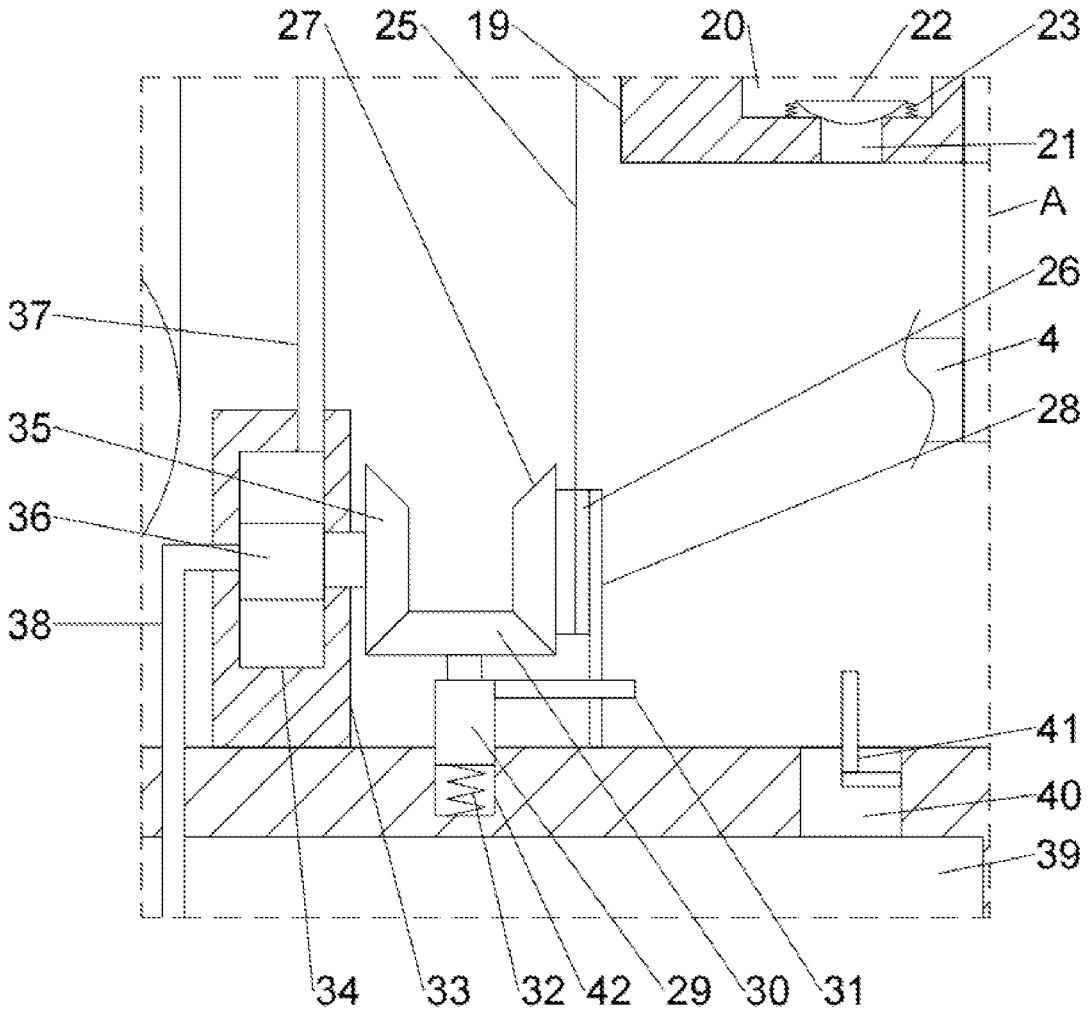
FIG. 3 is an enlarged diagram of A in FIG. 2 in the present invention.
Figure 4:
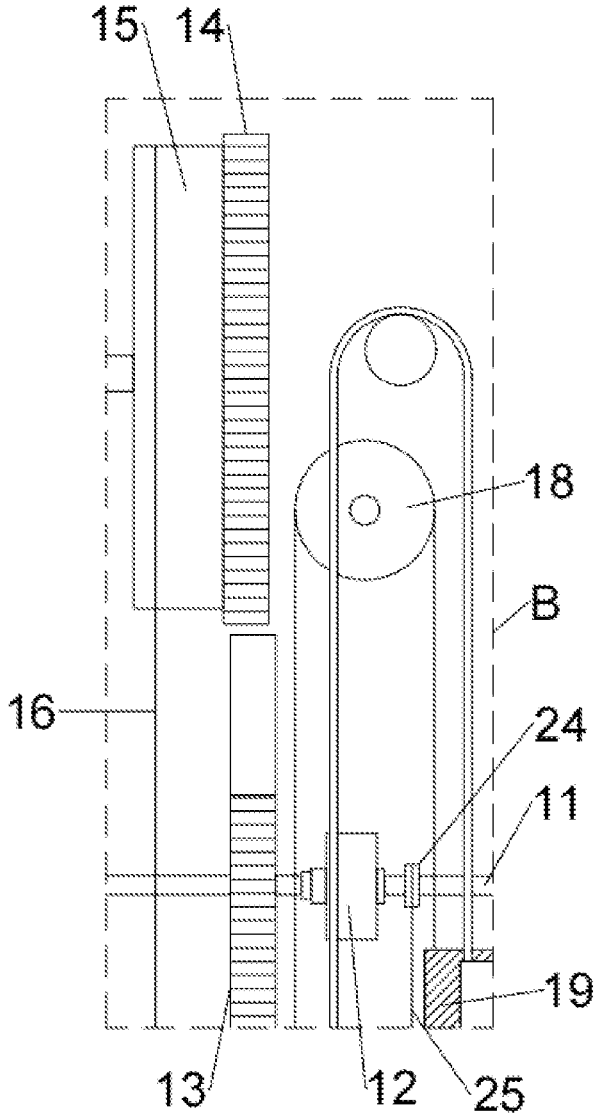
FIG. 4 is an enlarged diagram of B in FIG. 2 in the present invention.
Figure 5:
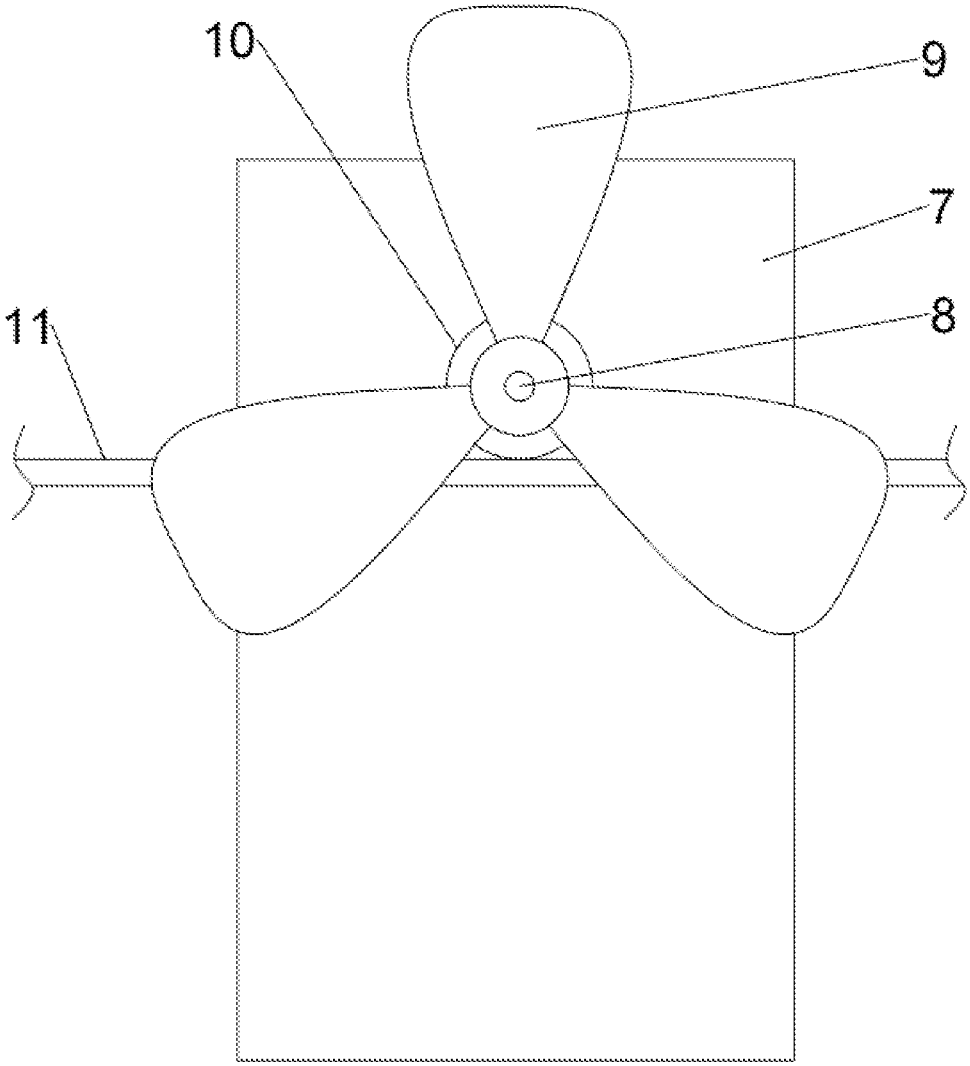
FIG. 5 is a main view of a motor and a fan blade in FIG. 2 in the present invention.
Figure 6:
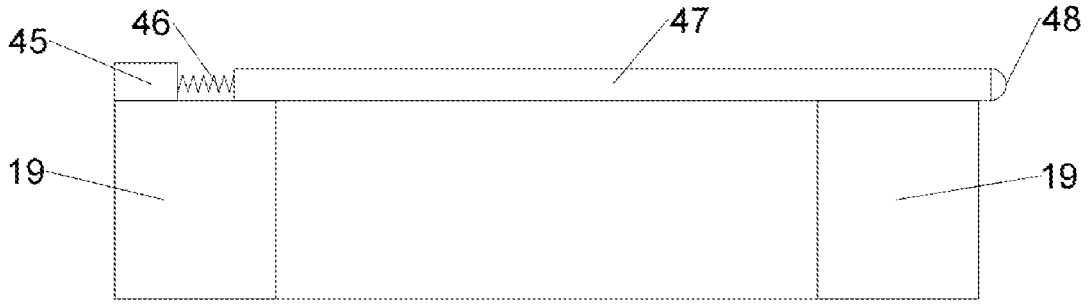
FIG. 6 is an enlarged diagram of a movable assistant heat dissipation mechanism in FIG. 2 in the present invention.
Figure 7:
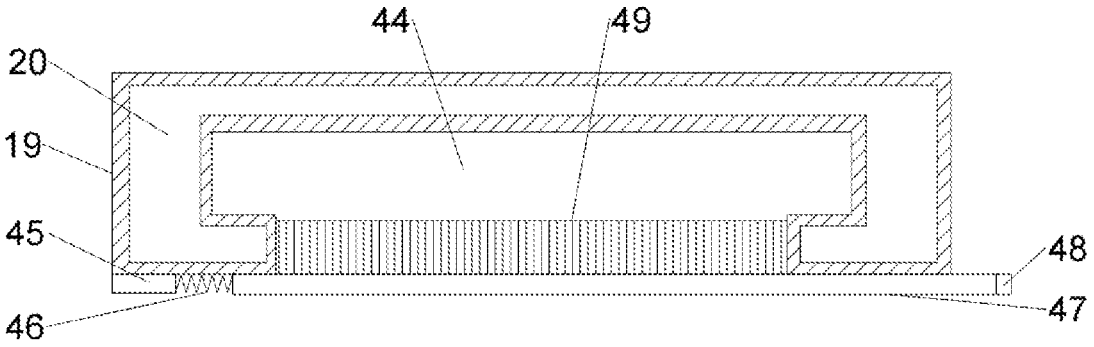
FIG. 7 is a top view of the movable assistant heat dissipation mechanism in FIG. 6 in the present invention.
Figure 8:
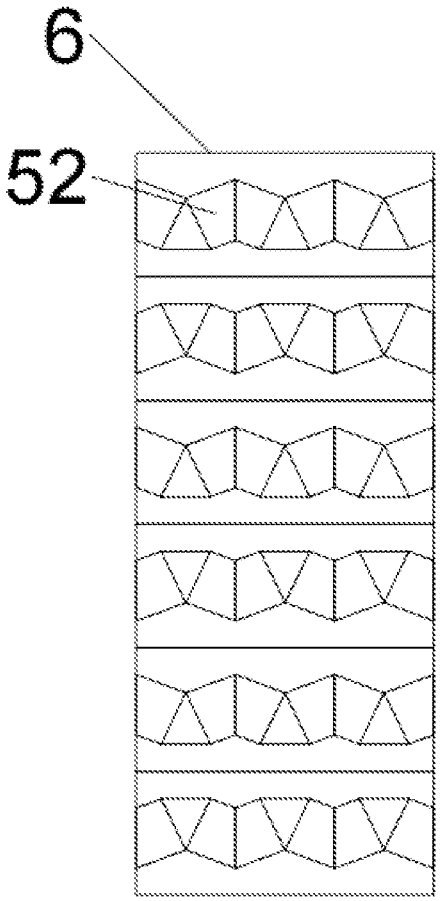
FIG. 8 is a right view of a heat dissipation fin in FIG. 2 in the present invention.

As shown in FIGS. 1-8, an air conditioning system, including a compressor, a condenser, a throttling device and an evaporator, where the compressor and the throttling device are respectively connected to the evaporator and are respectively connected to the condenser;

the condenser includes a shell 1, the shell 1 is internally provided with a cavity 2, a base 3 is fixedly connected to a bottom wall of the cavity 2, a heat dissipation base plate 5 and a motor body 7 are fixedly connected to a top wall of the base 3, a heat conducting aluminum flat tube 4 is fixedly connected to a side wall of the cavity 2, the heat conducting aluminum flat tube 4 is connected to the heat dissipation base plate 5, the heat dissipation base plate 5 is provided with more than two heat dissipation fins 6, the heat conducting aluminum flat tube 4 is arranged on the heat dissipation base plate 5, and a fan blade 9 is fixedly connected to a motor output shaft 8 of the motor body 7; and the heat dissipation base plate 5 is provided with a movable assistant heat dissipation mechanism, and the movable assistant heat dissipation mechanism is connected to the motor output shaft 8.

In an optional implementation of the present invention, the movable assistant heat dissipation mechanism includes a worm gear 10, a worm 11, a reducer 12, an incomplete gear 13, a first spur gear 14, a take-up reel 15, a drive line 16, a first guide wheel 17, a second guide wheel 18 and a heat dissipation tank 19; the worm gear 10 is fixedly connected to the motor output shaft 8; the worm 11 is rotatably connected to the side wall of the cavity 2; the worm 11 meshes with the worm gear 10; the worm 11 is fixedly connected to an input end of the reducer 12; the reducer 12 is fixedly connected to a back wall of the cavity 2; the incomplete gear 13 is fixedly connected to an output end of the reducer 12; the first spur gear 14 is fixedly connected to the take-up reel 15; the take-up reel 15 is rotatably connected to the side wall of the cavity 2; the first guide wheel 17 and the second guide wheel 18 both are rotatably connected to the back wall of the cavity 2; one end of the drive line 16 is fixedly connected to the take-up reel 15 and the other end of the drive line 16 bypasses the first guide wheel 17 and the second guide wheel 18 and is fixedly connected to the heat dissipation tank 19; the heat dissipation tank 19 is provided with a heat dissipation cavity 20 and a T-shaped trough 44; the heat dissipation cavity 20 is internally filled with a refrigerant; two inner walls of the T-shaped trough 44 are slidably connected to two side walls of the heat dissipation base plate 5, respectively; the inner walls of the T-shaped trough 44 are in contact with the heat conducting aluminum flat tube 4; and the heat dissipation tank 19 is made from a heat conduction material.

In an optional implementation of the present invention, the movable assistant heat dissipation mechanism further includes a block 22, a first elastic member 23, a first turning wheel 24, a drive belt 25, a second turning wheel 26, a first bevel gear 27, a connecting plate 28, a sliding block 29, a second bevel gear 30, an extension piece 31, a second elastic member 32, a pump body 33 and an L-shaped push rod 41; a bottom wall of the heat dissipation cavity 20 is connected to a bottom wall of the heat dissipation tank 19 through a liquid outlet channel 21, the block 22 is connected to the bottom wall of the heat dissipation cavity 20 through the first elastic member 23, the base 3 is provided with a liquid storage cavity 39, the liquid storage cavity 39 is internally filled with the refrigerant, a top wall of the liquid storage cavity 39 is connected to the top wall of the base 3 through a liquid return channel 40, the top wall of the base 3 is provided with a groove 42, the first turning wheel 24 is fixedly connected to the worm 11, the first turning wheel 24 is connected to the second turning wheel 26 through the drive belt 25, the second turning wheel 26 is rotatably connected to the connecting plate 28, the first bevel gear 27 is fixedly connected to the second turning wheel 26, the connecting plate 28 and the pump body 33 both are fixedly connected to the top wall of the base 3, the sliding block 29 is slidably connected to an inner wall of the groove 42, a bottom wall of the sliding block 29 is connected to the bottom wall of the groove 42 through the second elastic member 32, the second bevel gear 30 is rotatably connected to a top wall of the sliding block 29, the extension piece 31 is fixedly connected to a side wall of the slide block 29, the pump body 33 is provided with a pump cavity 34, an impeller 36 is rotatably connected to an inner wall of the pump cavity 34, a third bevel gear 35 is fixedly connected to the impeller 36, the third bevel gear 35 extends out of the pump body 33, the third bevel gear 35 and the first bevel gear 27 respectively mesh with the second bevel gear 30, a soft liquid outlet tube 37 and a liquid suction tube 38 connected to the pump cavity 34 are fixedly connected to the pump body 33, the liquid suction tube 38 extends into the liquid storage cavity 39, one end of the soft liquid outlet tube 37 is fixedly connected to the heat dissipation tank 19 and the other end of the soft liquid outlet tube 37 is connected to the heat dissipation cavity 20, a hanging strip 43 is fixedly connected to the back wall of the cavity 2, and the soft liquid outlet tube 37 is hung on the hanging strip 43.

In an optional implementation of the present invention, the heat dissipation tank 19 is provided with a cleaning mechanism; the cleaning mechanism includes a connecting piece 45, a third elastic member 46, a cleaning strip 47 and a first drive protrusion 48; and the connecting piece 45 is fixedly connected to the heat dissipation tank 19, the cleaning strip 47 is slidably connected to the heat dissipation tank 19, the cleaning strip 47 is connected to the connecting piece 45 through the third elastic member 46, the first drive protrusion 48 is fixedly connected to the cleaning strip 47, and more than two second drive protrusions 50 are fixedly connected to the side wall of the cavity 2.

In an optional implementation of the present invention, a recovery tank 51 is detachably connected to the bottom wall of the cavity 2.

Embodiment I: a refrigerant of the compressor flows into the heat conducting aluminum flat tube 4 and transfers heat to the heat conducting aluminum flat tube 4, the heat dissipation base plate 5 and the heat dissipation fins 6 successively for heat dissipation; the motor body 7 is started, the motor output shaft 8 on the motor body 7 drives the fan blade 9, the worm gear 10, the worm 11, the first turning wheel 24, the drive belt 25, the second turning wheel 26, the first bevel gear 27, the second bevel gear 30, the third bevel gear 35 and the impeller 36 to rotate rapidly, and the fan blade 9 generates wind, so that the heat on the heat dissipation base plate 5 and the heat dissipation fins 6 are dissipated rapidly, and the heat dissipation effect is accelerated; the impeller 36 rotates to generate a centrifugal force, so as to pump the refrigerant in the liquid storage cavity 39 to the pump cavity 34 and the soft liquid outlet tube 37 through the liquid suction tube 38, so that the refrigerant enters the heat dissipation cavity 20; the worm 11 is reduced by the reducer 12, so that the output end of the reducer 12 drives the incomplete gear 13 to rotate slowly, the incomplete gear 13 meshes with the first spur gear 14, the incomplete gear 13 drives the first spur gear 14 and the take-up reel 15 to rotate, and the take-up reel 15 stores the drive line 16, so that the drive line 16 pulls the heat dissipation tank 19 to move upwards; when moving upwards, the heat dissipation tank 19 transfers heat to different parts of the heat conducting aluminum flat tube 4 in a contact manner, so that the heat of the heat conducting aluminum flat tube 4 is transferred to the refrigerant in the heat dissipation tank 19 and the heat dissipation cavity 20, and therefore, the heat dissipation efficiency is improved; moreover, when moving, the dissipation tank 19 will improve the contact area with air, so that the heat dissipation efficiency of the dissipation tank 19 is improved; when the incomplete gear 13 rotates to a certain angle, it is separated from meshing with the first spur gear 14; the dissipation tank 19 moves downwards under the action of gravity, so that the take-up reel 16 is released, and the first spur gear 14 and the take-up reel 15 rotate reversely; when the dissipation tank 19 presses the extension piece 31 downwards, the extension piece 31 will drive the second bevel gear 30 and the sliding block 29 to move downwards along the groove 42 overcoming an elastic force of the second elastic member 32; the second bevel gear 30 is separated from meshing with the third bevel gear 35 and the first bevel gear 27; the impeller 36 stops rotating; the soft liquid outlet tube 37 stops adding the refrigerant into the heat dissipation cavity 20; the L-shaped push rod 41 will push the block 22 to move upwards overcoming an elastic force of the first elastic member 23, so that the heat dissipation cavity 20 is connected to the liquid outlet channel 21; the refrigerant in the heat dissipation cavity 20 passes through the liquid outlet channel 21 and the liquid return channel 40 and enters into the liquid storage cavity 39 for liquid exchange and cooling; when the refrigerant in the heat dissipation cavity 20 flows out completely, the incomplete gear 13 rotates to mesh with the first spur gear 14 again to drive the heat dissipation tank 19 to move upwards; after the extension piece 31 losses the pressure of the heat dissipation tank 19, the sliding block 29, the second bevel gear 30 and the extension piece 31 move upward to reset under the elastic force of the second elastic member 32; and the second bevel gear 30 meshes with the first bevel gear 27 and the third bevel gear 35 again, so that the impeller 36 rotates to suck the liquid, and the refrigerant in the liquid storage cavity 39 is added into the heat dissipation cavity 20, so that the cooling function of the heat dissipation tank 19 is ensured. The heat dissipation tank 19 moves up and down in a reciprocating manner by means of the principle.

When the heat dissipation tank 19 moves up and down in a reciprocating manner, it will drive the cleaning strip 47 and the cleaning hairbrush 49 to move up and down in a reciprocating manner, so that the cleaning hairbrush 49 wipes and cleans dust on the heat dissimilation fins 6, and the heat dissipation effect of the heat dissimilation fins 6 is ensured; the first drive protrusion 48 will collide with all second drive protrusions 50 on the side wall of the cavity 2, so that the cleaning strip 47 moves leftwards overcoming the elastic force of the third elastic member 46; when the first drive protrusion 48 is separated from the second drive protrusions 50, the cleaning strip 47 will move rightwards to reset under the elastic force of the third elastic member 46; thus, left-right reciprocating motions are completed, so that the cleaning hairbrush 49 can not only move up and down to clean the heat dissipation fins 6, but also can move left and right to clean the heat dissipation fins 6, so that the cleaning area is improved, the cleaning dead angle is reduced, the cleaning quality is improved, the heat dissipation effect on the dissipation fins 6 is improved, and cleaned falling impurities enter the recovery tank 51 for collection.

The heat dissipation tank 19 can be arranged in an L shape. The heat conducting aluminum flat tube 4 can be arranged on the heat dissipation base plate 5 in a parallel flow form. The heat conducting aluminum flat tube 4 can also be arranged on the heat dissipation base plate 5 in a sinuous form.

In the embodiment, driven by the motor body 7, a cleaning hairbrush 49 in terms of a conventional technology can rotate to generate wind power, and the heat dissipation tank 19 can also be driven to reciprocate up and down, so that the heat dissipation tank 19 performs contact heat transfer with different parts of the heat conducting aluminum flat tube 4 and matches with the cleaning hairbrush 49 to complete assistant heat dissipation, so that the heat dissipation efficiency is improved and the heat dissipation function of the heat dissipation tank 19 is ensured. The cleaning strip 47 and the cleaning hairbrush 49 can also be driven to clean the heat dissipation fins 6 while the heat dissipation tank 19 reciprocates up and down, so that the heat dissipation function of the heat dissipation fins 6 is ensured.

In an optional implementation of the present invention, a method for manufacturing the heat dissipation fins 6 includes: extruding, by upper and lower dies, folds to form the heat dissipation fins, and the heat dissipation fins 6 are wavy.

In an optional implementation of the present invention, a material of the heat dissipation fins 6 includes trace elements.

In an optional implementation of the present invention, each of the heat dissipation fins 6 is provided with more than two fin troughs 52.

In an optional implementation of the present invention, the heat dissipation fin 6 is provided with more than two fin bumps.

In an optional implementation of the present invention, a thickness of the heat dissipation fin 6 is 0.06-0.20 mm.

Embodiment II

The heat dissipation fins 6 are manufactured by extrusion forming the upper and lower dies. Different from a rolling mode to form the fins in the conventional technology, the strip heat dissipation fins 6 are formed in the rolling mode. The formed wavy heat dissipation fins 6 feature large area and increased wind drag, so that the heat dissipation effect can be improved. The heat dissipation fins can be directly flushed with water, and the heat dissipation fins 6 in such a shape will not topple, so that the condenser is conveniently used in a severely polluted environment, for example, an agricultural machine. The added trace elements manganese and silicon both have good heat conduction performance. The heat dissipation fins are superior to conventional fins. Manganese is high in hardness, so that the rigidity of the heat dissipation fins 6 can be improved, and the performance to resist external forces is improved.

Components, modules, mechanisms and devices, which are not described in detail, in the present invention are universal standard components or components known to those skilled in the art, and their structures or principles may be known by those skilled in the art via technical manuals or acquired by conventional experimental methods.

Finally, it is to be noted that the above embodiments are merely used to explain the technical scheme of the present invention rather than limiting the protection scope of the present invention. Despite reference to the preferred embodiments to make a detailed description for the present invention, it will be understood by those skilled in the art that they still can modify the technical scheme of the present invention or make equivalent substitutions on the technical scheme without departing the substance and scope of the technical scheme of the present invention.

What is claimed:

1. An air conditioning system, comprising a compressor, a condenser, a throttling device and an evaporator, wherein the compressor and the throttling device are respectively connected to the evaporator and are respectively connected to the condenser;

the condenser comprises a shell (1), the shell (1) is internally provided with a cavity (2), a base (3) is fixedly connected to a bottom wall of the cavity (2), a heat dissipation base plate (5) and a motor body (7) are fixedly connected to a top wall of the base (3), a heat conducting aluminum flat tube (4) is fixedly connected to a side wall of the cavity (2), the heat conducting aluminum flat tube (4) is connected to the heat dissipation base plate (5), the heat dissipation base plate (5) is provided with more than two heat dissipation fins (6), the heat conducting aluminum flat tube (4) is arranged on the heat dissipation base plate (5), and a fan blade (9) is fixedly connected to a motor output shaft (8) of the motor body (7); and the heat dissipation base plate (5) is provided with a movable assistant heat dissipation mechanism, and the movable assistant heat dissipation mechanism is connected to the motor output shaft (8).

2. The air conditioning system according to claim 1, wherein the movable assistant heat dissipation mechanism comprises a worm gear (10), a worm (11), a reducer (12), an incomplete gear (13), a first spur gear (14), a take-up reel (15), a drive line (16), a first guide wheel (17), a second guide wheel (18) and a heat dissipation tank (19); the worm gear (10) is fixedly connected to the motor output shaft (8); the worm (11) is rotatably connected to the side wall of the cavity (2); the worm (11) meshes with the worm gear (10); the worm (11) is fixedly connected to an input end of the reducer (12); the reducer (12) is fixedly connected to a back wall of the cavity (2); the incomplete gear (13) is fixedly connected to an output end of the reducer (12); the first spur gear (14) is fixedly connected to the take-up reel (15); the take-up reel (15) is rotatably connected to the side wall of the cavity (2); the first guide wheel (17) and the second guide wheel (18) both are rotatably connected to the back wall of the cavity (2); one end of the drive line (16) is fixedly connected to the take-up reel (15) and the other end of the drive line (16) bypasses the first guide wheel (17) and the second guide wheel (18) and is fixedly connected to the heat dissipation tank (19); the heat dissipation tank (19) is provided with a heat dissipation cavity (20) and a T-shaped trough (44); the heat dissipation cavity (20) is internally filled with a refrigerant; two inner walls of the T-shaped trough (44) are slidably connected to two side walls of the heat dissipation base plate (5), respectively; the inner walls of the T-shaped trough (44) are in contact with the heat conducting aluminum flat tube (4); and the heat dissipation tank (19) is made from a heat conduction material.

3. The air conditioning system according to claim 2, wherein the movable assistant heat dissipation mechanism further comprises a block (22), a first elastic member (23), a first turning wheel (24), a drive belt (25), a second turning wheel (26), a first bevel gear (27), a connecting plate (28), a sliding block (29), a second bevel gear (30), an extension piece (31), a second elastic member (32), a pump body (33) and an L-shaped push rod (41); a bottom wall of the heat dissipation cavity (20) is connected to a bottom wall of the heat dissipation tank (19) through a liquid outlet channel (21), the block (22) is connected to the bottom wall of the heat dissipation cavity (20) through the first elastic member (23), the base (3) is provided with a liquid storage cavity (39), the liquid storage cavity (39) is internally filled with the refrigerant, a top wall of the liquid storage cavity (39) is connected to the top wall of the base (3) through a liquid return channel (40), the top wall of the base (3) is provided with a groove (42), the first turning wheel (24) is fixedly connected to the worm (11), the first turning wheel (24) is connected to the second turning wheel (26) through the drive belt (25), the second turning wheel (26) is rotatably connected to the connecting plate (28), the first bevel gear (27) is fixedly connected to the second turning wheel (26), the connecting plate (28) and the pump body (33) both are fixedly connected to the top wall of the base (3), the sliding block (29) is slidably connected to an inner wall of the groove (42), a bottom wall of the sliding block (29) is connected to a bottom wall of the groove (42) through the second elastic member (32), the second bevel gear (30) is rotatably connected to a top wall of the sliding block (29), the extension piece (31) is fixedly connected to a side wall of the sliding block (29), the pump body (33) is provided with a pump cavity (34), an impeller (36) is rotatably connected to an inner wall of the pump cavity (34), a third bevel gear (35) is fixedly connected to the impeller (36), the third bevel gear (35) extends out of the pump body (33), the third bevel gear (35) and the first bevel gear (27) respectively mesh with the second bevel gear (30), a soft liquid outlet tube (37) and a liquid suction tube (38) connected to the pump cavity (34) are fixedly connected to the pump body (33), the liquid suction tube (38) extends into the liquid storage cavity (39), one end of the soft liquid outlet tube (37) is fixedly connected to the heat dissipation tank (19) and the other end of the soft liquid outlet tube (37) is connected to the heat dissipation cavity (20), a hanging strip (43) is fixedly connected to the back wall of the cavity (2), and the soft liquid outlet tube (37) is hung on the hanging strip (43).

4. The air conditioning system according to claim 3, wherein the heat dissipation tank (19) is provided with a cleaning mechanism; the cleaning mechanism comprises a connecting piece (45), a third elastic member (46), a cleaning strip (47) and a first drive protrusion (48); and the connecting piece (45) is fixedly connected to the heat dissipation tank (19), the cleaning strip (47) is slidably connected to the heat dissipation tank (19), the cleaning strip (47) is connected to the connecting piece (45) through the third elastic member (46), the first drive protrusion (48) is fixedly connected to the cleaning strip (47), and more than two second drive protrusions (50) are fixedly connected to the side wall of the cavity (2).

5. The air conditioning system according to claim 4, wherein a recovery tank (51) is detachably connected to the bottom wall of the cavity (2).

* * * * *